US007309295B2

(12) United States Patent
Solari

(10) Patent No.: US 7,309,295 B2
(45) Date of Patent: Dec. 18, 2007

(54) FLARED CHIPPER OR WEDGE FOR GOLF

(76) Inventor: Ray Solari, 531 Main St., Suite 1105, El Segundo, CA (US) 90245

( * ) Notice: Subject to any disclaimer, the term of this patent is extended or adjusted under 35 U.S.C. 154(b) by 33 days.

(21) Appl. No.: 11/290,911

(22) Filed: Nov. 30, 2005

(65) Prior Publication Data

US 2007/0123366 A1 May 31, 2007

(51) Int. Cl.
*A63B 53/04* (2006.01)

(52) U.S. Cl. ..... 473/328; 473/345; 473/349

(58) Field of Classification Search ..... 473/345, 473/350, 324, 328, 327, 349
See application file for complete search history.

(56) References Cited

U.S. PATENT DOCUMENTS

| | | | | |
|---|---|---|---|---|
| 2,517,245 | A | 8/1950 | Scott | 273/77 |
| 4,043,563 | A | 8/1977 | Churchward | 273/171 |
| 4,340,230 | A | 7/1982 | Churchward | 273/171 |
| 4,695,054 | A | 9/1987 | Tunstall | 273/171 |
| 4,836,550 | A * | 6/1989 | Kobayashi | 473/350 |
| 4,892,316 | A * | 1/1990 | Langert et al. | 473/305 |
| 5,050,879 | A | 9/1991 | Sun et al. | 273/80 A |
| 5,297,794 | A | 3/1994 | Lu | 273/171 |
| 5,385,348 | A | 1/1995 | Wargo | 273/171 |
| D371,408 | S | 7/1996 | Ashcraft et al. | D21/221 |
| 5,599,243 | A | 2/1997 | Kobayashi | 473/335 |
| 5,676,606 | A | 10/1997 | Schaeffer et al. | 473/340 |
| 5,916,042 | A | 6/1999 | Reimers | 473/334 |
| D415,807 | S | 10/1999 | Werner et al. | D21/733 |
| 6,015,354 | A * | 1/2000 | Ahn et al. | 473/256 |
| 6,030,295 | A | 2/2000 | Takeda | 473/345 |
| 6,077,171 | A | 6/2000 | Yoneyama | 473/291 |
| 6,089,994 | A | 7/2000 | Sun | 473/338 |
| 6,290,609 | B1 | 9/2001 | Takeda | 473/335 |
| 6,342,018 | B1 | 1/2002 | Mason | 473/252 |
| D458,328 | S | 6/2002 | Solheim et al. | D21/747 |
| 6,440,010 | B1 | 8/2002 | Deshmukh | 473/335 |
| 6,454,663 | B1 * | 9/2002 | Bakke | 473/328 |
| 6,458,044 | B1 | 10/2002 | Vincent et al. | 473/334 |
| 6,569,029 | B1 | 5/2003 | Hamburger | 473/238 |
| 6,645,085 | B2 | 11/2003 | McCabe et al. | 473/290 |
| 6,648,772 | B2 | 11/2003 | Vincent et al. | 473/334 |
| 6,719,641 | B2 | 4/2004 | Dabbs et al. | 473/291 |
| 6,719,642 | B2 | 4/2004 | Wahl et al. | 473/291 |
| D495,019 | S | 8/2004 | Nathanson | D21/748 |
| 6,811,496 | B2 | 11/2004 | Wahl et al. | 473/334 |
| 6,984,180 | B2 * | 1/2006 | Hasebe | 473/291 |
| 2002/0042305 | A1 * | 4/2002 | Otoguro | 473/328 |
| 2002/0137576 | A1 | 9/2002 | Dammen | 473/336 |
| 2003/0232659 | A1 | 12/2003 | Mahaffey et al. | 473/256 |
| 2004/0176177 | A1 | 9/2004 | Mahaffey et al. | 473/256 |

FOREIGN PATENT DOCUMENTS

| | | |
|---|---|---|
| JP | 2002011123 | 1/2002 |

* cited by examiner

*Primary Examiner*—Stephen Blau

(57) ABSTRACT

A golf club head for a chipper or wedge provides a large striking area as well as selectable weight distribution. Using a flared hosel coupled to a lobed or large blade, the body supporting the blade provides both a concave sole for selectable bounce upon manufacture as well as an open interior cavity having an enclosing lid enabling the permanent or removable fixation of weights for selectable weight distribution. A concave cavity within the sole allows for the passage of dirt, sand, or other material to enable better golf shots.

14 Claims, 6 Drawing Sheets

FLARED CHIPPER OR WEDGE FOR GOLF

COPYRIGHT AUTHORIZATION

Portions of the disclosure of this patent document may contain material which is subject to copyright and/or mask work protection. The copyright and/or mask work owner has no objection to the facsimile reproduction by anyone of the patent document or the patent disclosure, as it appears in the Patent and Trademark Office patent file or records, but otherwise reserves all copyright and/or mask work rights whatsoever.

BACKGROUND OF THE INVENTION

1. Field of the Invention

This invention relates to relates to golf clubs and more particularly a customizable chipper or wedge that is flared.

2. Description of the Related Art

Golf is a well known game played for many years by millions of individuals. The game generally focuses upon hitting a small ball long distances into a correspondingly small hole. Regulations of the game generally allow a golfer to carry fourteen clubs in his bag. Of these, the clubs are generally split into three categories: drivers or woods, irons, and putters. The golfer generally carries a few woods, several irons, and a single putter.

Each aspect of the game of golf has its certain challenges. The initial drive requires strength, speed, and reliability so that the heavy head end of the driver, or wood, sends the ball down the fairway generally as far as possible. At the end of the hole, when the golfer is on the green, a putter is generally used to roll the ball into the hole. Between the driving game and putting game, the irons are used to approach the green and possibly sink the ball into the hole.

While there are professional golfers of great skill, many people enjoy the game of golf that do not have great skill and/or enjoy large handicaps. Handicapping is a way of generally allowing players of less ability to compete with those who have more. By taking a number of strokes off the score at the end of the game, these strokes taken off being the "handicap," each individual can compete at their own level and can compare scores/performance with those of varying skill levels.

Another way to compensate for higher scores/lower performance on the golf course is to use devices, in the form of golf clubs, that help one's game. With respect to the irons in the golfer's golf bag that are used to approach the green, a number of golf club variations have arisen in the art. Several of these attempt to compensate for bad habits or persistent idiosyncrasies of golfers in order to compensate for any shortcomings in the golf swing or otherwise.

While no perfect golf club has yet been achieved that enables all players to approach the playing level of the tour professional, many approaches remain to be explored so that better golf clubs can be provided to individuals seeking help in their golf game.

SUMMARY OF THE INVENTION

In view of the foregoing disadvantages inherent in the known types of golf clubs, particularly irons, now present in the prior art, the present invention provides a new chipper or wedge that helps the golfer achieve a better golf shot while minimizing the problems from hitting shank shots, thin shots, and fat shots.

The general purpose of the present invention, which will be described subsequently in greater detail, is to provide a new chipper or wedge that aids the golfer in achieving golf shots and that provides means by which such golf club can be weight adjusted and have the weight distribution and overall weight selectably adjusted by the golfer which is not anticipated, rendered obvious, suggested, taught, or even implied by any prior art golf clubs, either alone or in any combination thereof.

The golf club of the present invention takes the form of a chipper or a wedge that allows the golfer to make shots after the initial drive or those that take the ball closer to the green as an approach shot. By having a large striking surface, as well as a flared hosel, the golf club provides the golfer a means by which he or she can better hit the ball. Additionally, due to the sole that is present from a hollowed body situated beneath the blade, sand and dirt easily passes through, or beneath the club should a "fat" shot be hit where the golfer actually strikes the ground beneath the ball and not necessarily the area immediately below the ball. Furthermore, such passage of sand and dirt may occur when the ball is on a soft surface and the golf club is intentionally or otherwise driven into the ground to alter the flight path of the ball.

The hollowed body has a lid and within the interior confines of the interior cavity, as well as the back, or inside of the lid, weights may be cast or affixed in order to create additional weight (and thereby additional momentum that can be imported to the ball) as well as particularly and precisely controlling the weight distribution across and within the golf club head.

In one embodiment of the present invention, a chipper or wedge golf club for golf may have a blade having an angled face having a lobed portion proximal to a toe of the blade. Coupled to the blade may be a hosel that is coupled to the blade proximal to a heel of the blade. A body extending rearwardly and below the blade may help to support the blade above the ground and generally at a preferred or default angle thereto. The body may define an interior cavity which has an opening at a rearward portion thereof to provide access to the interior cavity. The body may provide a sole for the blade with the sole being generally convex along a long axis thereof which may generally extend from the heel to the toe and generally parallel to a plane of the face. The sole may define a concave cavity which has a wider open portion proximal a leading edge of the blade and a narrower closed portion distal from the leading edge such that a chipper or wedge golf club is provided that aids a golfer in making more consistent golf shots of generally shorter distance.

In another embodiment of the present invention, a chipper or wedge golf club for golf has a blade having an angled face, the angled face having a leading edge, a heel, and a toe, the blade having a lobed portion proximal to the toe of the blade. A hosel is coupled to the blade proximal to its heel. The hosel is flared at a flared section proximal to the blade and the hosel generally has an elliptical cross section at the flared section. The hosel may be coupled to the blade proximal to the heel anywhere along that portion of the blade. The hosel may be coupled to the blade at an angle from approximately the vertical (90°) to approximately 65°. A body extends rearwardly and below the blade and defines an interior cavity. The interior cavity may have an opening at a rearward portion thereof to provide access to it. The blade may extend upwardly and rearwardly past the body to provide a projecting portion of the blade. In one embodiment, this projecting portion may take the form of an upwardly extending lobe. A weight may be provided with the weight being selectable and coupled to the body within the interior cavity. The weight may be removably attachable to the body or permanently attached to the body.

A lid may be provided that is coupleable to the body with the lid serving to cover the interior cavity. The lid may have one lid weight or more with such a lid weight being selectable and coupled to the lid on a side of the lid facing the interior cavity. Such a lid weight may be selected from lid weights that removably attach to the lid and lid weights that are permanently attached to the lid.

The lobed portion of the blade may be positioned generally distal to both the leading edge and the hosel, with the lobed portion generally proximal to and above the toe. The body may also provide a sole for the blade with the sole being generally convex along a long axis thereof generally extending from the heel to the toe and generally parallel to a plane of the face. The sole may define a concave cavity with the concave cavity having a wider open portion proximal a leading edge of the blade and a narrower closed portion distal from the leading edge such that the combination above provides a chipper or wedge golf club that aids a golfer in making more consistent golf shots of shorter distance.

In another embodiment of the present invention, a method of providing a chipper or wedge golf club for golf may include the steps of: providing a blade that may have an angled face with the face having a lobed portion proximal to a toe of the blade; coupling a hosel to the blade proximal to a heel of the blade; providing a body, the body extending rearwardly and below the blade and defining an interior cavity, which interior cavity may have an opening at a rearward portion thereof to provide access to the interior cavity; providing a sole for the blade via the body, which sole may be generally convex along a long axis thereof and may generally extend from the heel to the toe and may be generally parallel to a plane of the face; and defining a concave cavity in the sole, which concave cavity may have a wider open portion proximal a leading edge of the blade and a narrower closed portion distal from the leading edge such that a chipper or wedge golf club is provided that aids a golfer in making more consistent golf shots of shorter distance.

In another embodiment of the present invention, a method of providing a chipper or wedge golf club for golf may include the steps of: providing a blade having an angled face, the angled face having a leading edge, a heel, and a toe, the blade having a lobed portion proximal to the toe of the blade, the lobed portion positioned generally distally to the leading edge and the hosel, the lobed portion generally proximal to and above the toe; coupling the hosel to the blade proximal to a heel of the blade, the hosel being flared at a flared section proximal to the blade, and the hosel having a generally elliptical cross section at the flared section and the hosel coupled to the blade proximal to the heel anywhere along the blade, the hosel also being coupled to the blade at an angle from approximately the vertical (90°) to approximately 65°; providing a body extending rearwardly and below the blade, the body coupled to the blade and defining an interior cavity, the interior cavity having an opening at a rearward portion thereof to provide access to the interior cavity, the blade extending upwardly and rearwardly past the body to provide a projecting portion of the blade; coupling a weight to the body, the weight being selectable and coupled to the body within the interior cavity; the weight selected from weights removably attachable to the body and weights permanently attached to the body; coupling a lid to the body, the lid covering the interior cavity; coupling a lid weight to the lid, the lid weight being selectable and coupled to the lid on a side of the lid facing the interior cavity, the lid weight selected from lid weights removably attachable to the lid and lid weights permanently attached to the lid; providing a sole for the blade via the body, the sole being generally convex along a long axis thereof generally extending from the heel to the toe and generally parallel to a plane of the face; defining a concave cavity in the sole, the concave cavity having a wider open portion proximal a leading edge of the blade and a narrower closed portion distal from the leading edge such that a chipper or wedge golf club is provided that aids a golfer in making more consistent golf shots of shorter distance.

DESCRIPTION OF THE PREFERRED EMBODIMENT(S)

Figure 1:
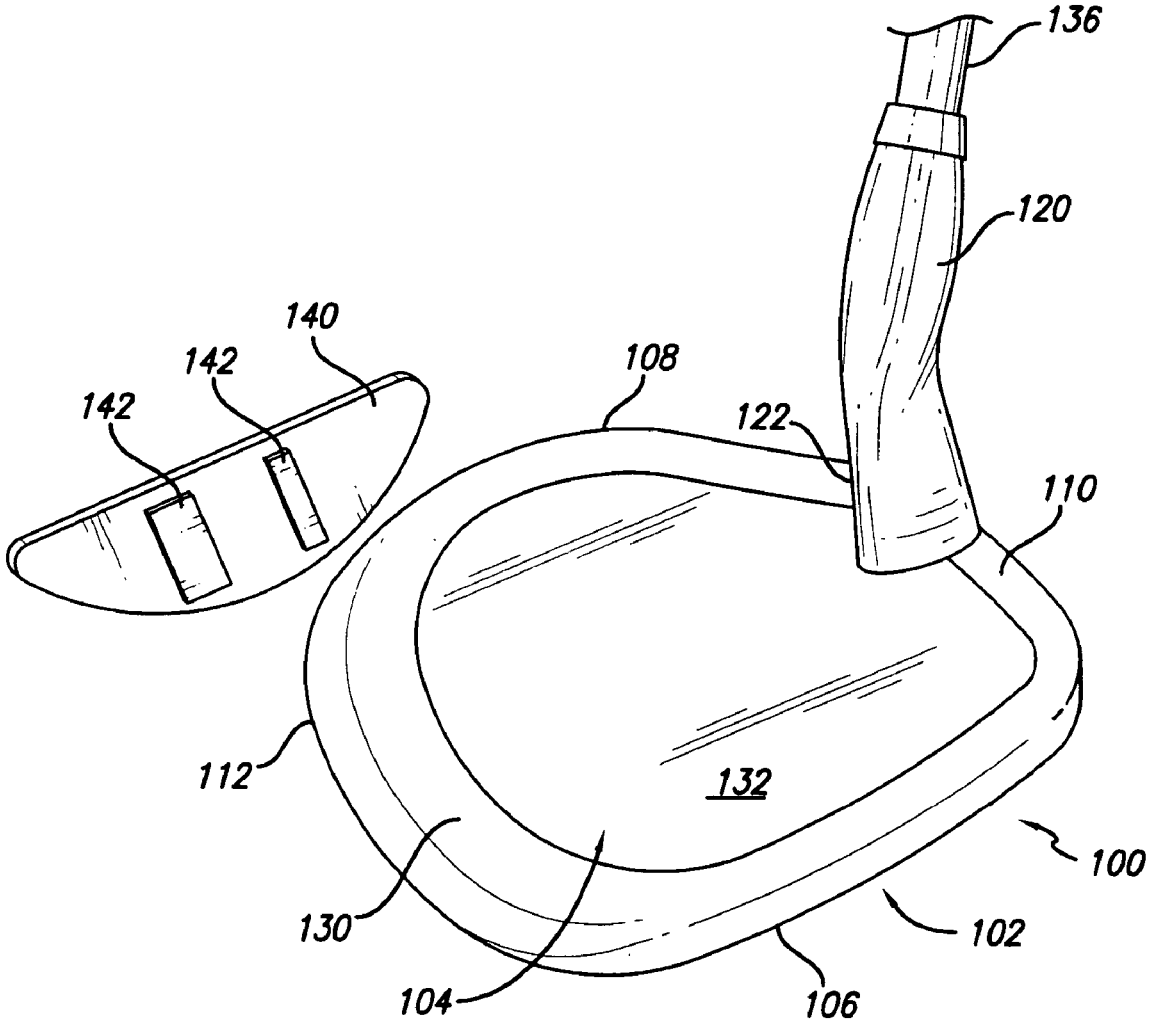
FIG. 1 is a front right partially exploded and perspective view of the flared chipper or wedge for golf as set forth herein with the lid and associated lid weights shown in the exploded view.

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

The present invention resides in a chipper, wedge, or iron that helps the amateur, beginning, or lower performing golfer to hit better shots due to the fact that the weight distribution of the golf club head may be selectably adjusted as well as there being a large blade area to provide a larger and easier-to-hit striking surface as well as being able to channel and/or direct earth, dirt, or sand beneath the club due to a concave cavity within the sole. Additionally, a flared hosel is used for additional aid in making the golf shot. The resulting club helps to prevent and to make better shots that are thin, fat, or that are shanked.

Referring to the drawings, where like numerals of reference designate like elements throughout, it will be noted that the golf club 100 has several unique features working in tandem and in coordination in order to provide the flared chipper or wedge for golf of the present invention. The golf club has a blade 102 with a face 104 as well as a leading edge 106, a trailing edge or top 108, a heel 110, and a toe 112. A hosel 120 is connected to the blade 102 along with face 104. More description with regards to the placement of the hosel is given in reference to FIGS. 4 and 5, below.

Note should be taken that the hosel 120 has a flare 122 as it approaches and meets the blade 102.

The blade 102 may have a circumscribing portion 130 that circumscribes a faceplate 132 with the circumscribing portion 130 and the face portion 132 providing the face 104.

A shaft 136 may lead into the hosel 120.

Figure 2:
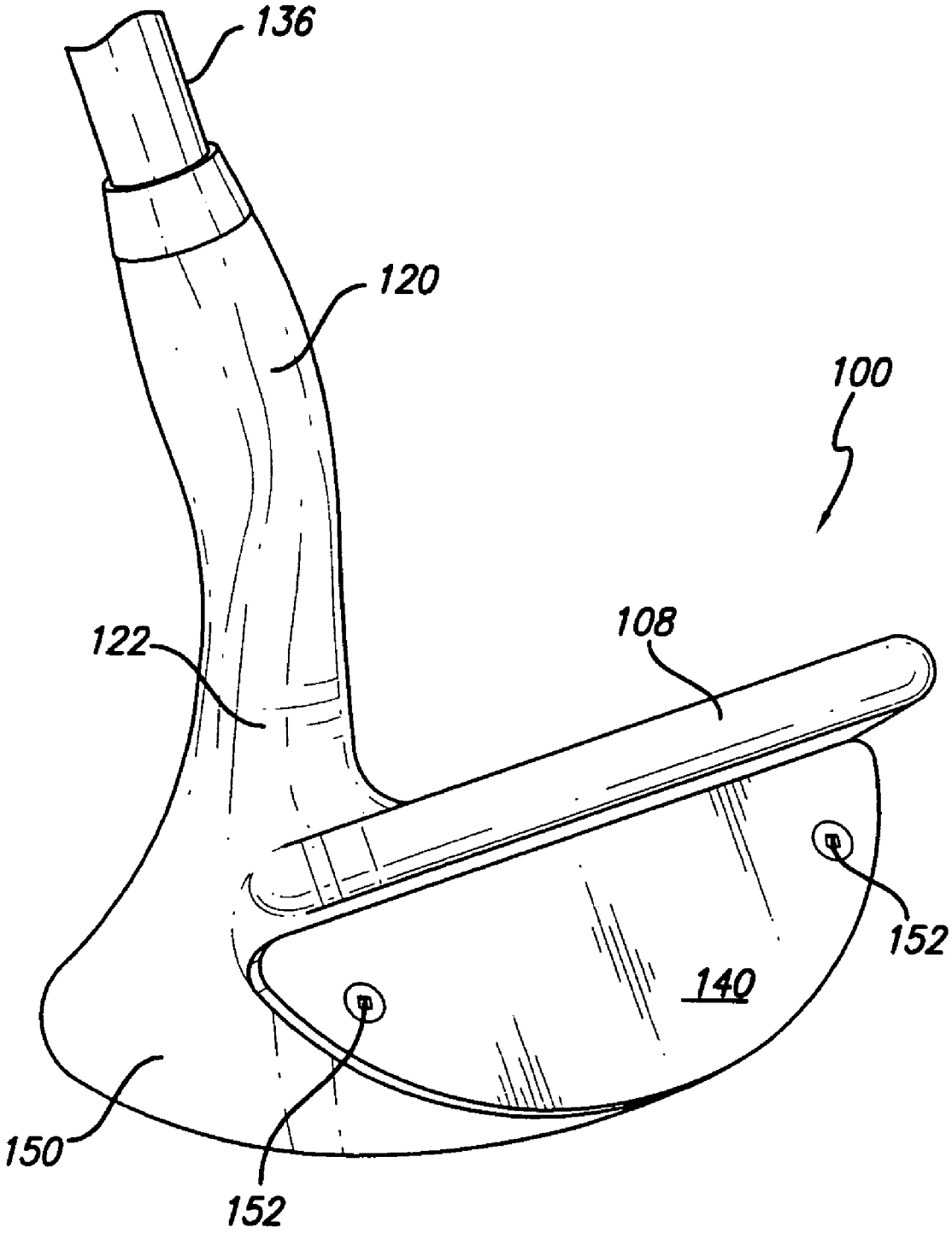
FIG. 2 is a rear left side and perspective view of the flared chipper or wedge for golf as shown in FIG. 1.

As shown in FIG. 1, a lid or backplate 140 may have a semi-lunar or semi-circular shape with one or more weights 142 attached to the inside of the lid 140. As shown in FIG. 2, the lid 140 may be attached to the body 150 of the golf club head 100 as by screws or bolts 152.

Figure 7:
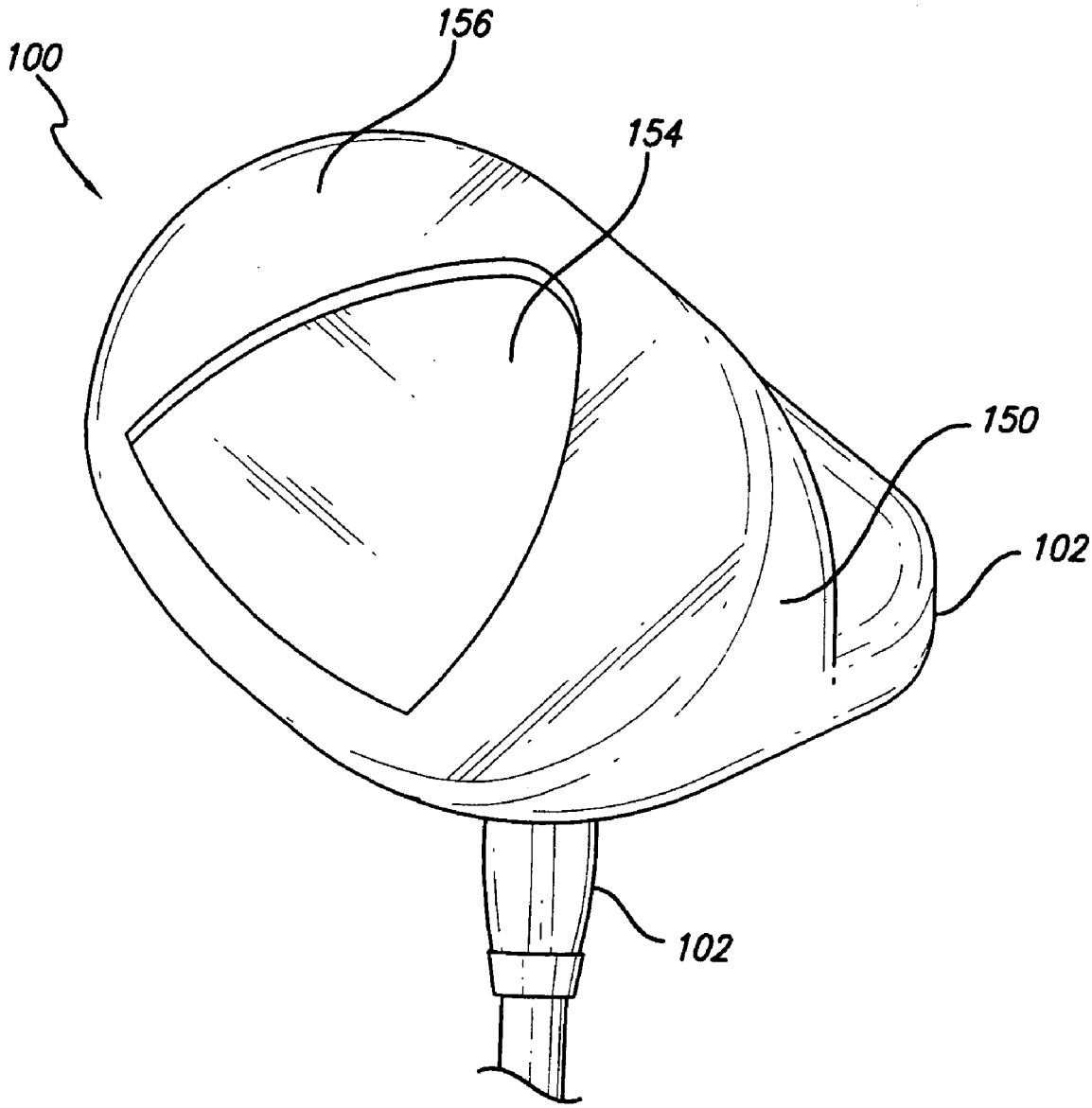
FIG. 7 is a right side rear and perspective view of the golf club head shown FIGS. 1 and 2 showing the concave cavity of the sole.

The body 150 generally forms the under portion of the golf club head 100 and serves to support the blade 102 above the ground in a constructive fashion so that there is greater support for the blade 102 before, during, and after the shot. The body 150 serves to lift the blade 102 above the ground and as shown in FIG. 7, the blade has a concaved recess or cavity 154 into which and through which earth, sand, dirt, or other debris or particulate matter may pass so that a shot that drives the leading edge 106 the golf club head 100 into the ground before the golf ball may still impart a reasonably good shot as there will be less obstruction by such dirt or sand. The concave cavity 154 is embedded into the sole, or bottom, 156 of the body 150. The sole 156 generally provides what is called the "bounce" or the default angle of disposition of the blade 102 with respect to the golf ball (not shown) on the ground. This bounce causes the blade (which is the striking element of the golf club head 100) to better lift the ball during the impact or strike. Consequently, it generally controls to at least a certain degree how the ball is struck by the golf club head 100.

As shown in FIG. 7, the sole 156 may be generally concave along its long and short axes. In this way, due to the direction of the swing of the club, the bounce is present wherever the golf ball is struck by the blade 102 as generally the same concave curvature of the sole 156 serves to prevent the blade 102 from digging further into the ground.

Figure 3:
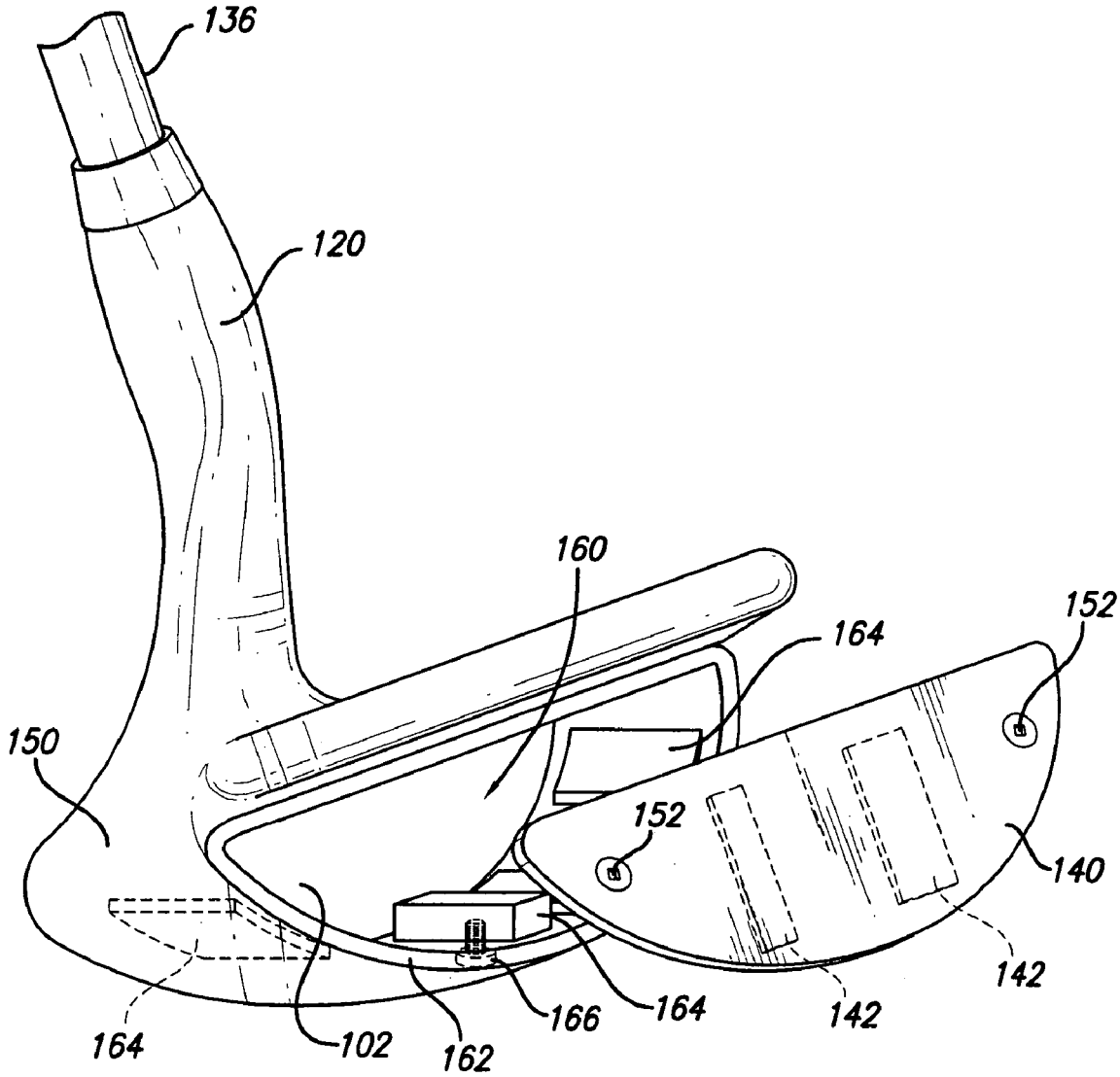
FIG. 3 a rear left perspective and partially exploded view of the chipper shown in FIG. 2 with the lid removed from the body to show the interior cavity with its weights and with the weights on the lid shown in phantom.

FIG. 3 shows an exploded view of the golf club head 100 with the lid 140 removed from the face of interior cavity 160 thereby showing the contents and geometry of the interior cavity 160. The lid 140 fits across the face 162 of the interior cavity 160 and thereby encloses the space defined by the body 150. The front of the interior cavity is completely closed by the blade 102 and, as indicated previously, screws or bolt 152 serve to hold the lid 140 on the face 162 of the interior cavity 160.

The interior cavity 160 generally has geometry similar to that of the body 150 and such is shown in FIG. 3. However, in alternative embodiments, the disposition of the cavity weights 164 serve to alter, supplement, complement, or otherwise redefine the geometry of the interior cavity. The cavity weights 164 may be generally of any shape, size, or weight, so long as they fit within the confines of the interior cavity 160. General practice dictates somewhat that the weights serve to fine tune the total weight and/or the weight distribution within the golf club head as whole. However, there is nothing preventing a single large weight from being placed within the interior cavity so long as it fits within the confines therein.

As shown in FIG. 3, a central weight 164 at the bottom of the interior cavity 160 is held in place by a bolt or screw 166. The use of such bolts or screws 166 allows for adjustment and replacement of the weights 164. In this way, the weights 164 may be adjustable and/or removable. Other means of attachment or fixation may be used as known in the art or may be developed as is true for the other components of the golf club head 100. In a similar manner, the weights 142 of the lid 140 may be permanently or removably attached to the lid 140. The weights may be made of any reasonably resilient substance from steel, to precious metals, to plastic. By judiciously selecting the mass, geometry, and location of both the interior cavity weights 164 and lid weights 142, total weight of the golf club head as well as the weight distribution within the golf club head 100 can be adjustably and/or selectably altered or configured.

Figure 4:
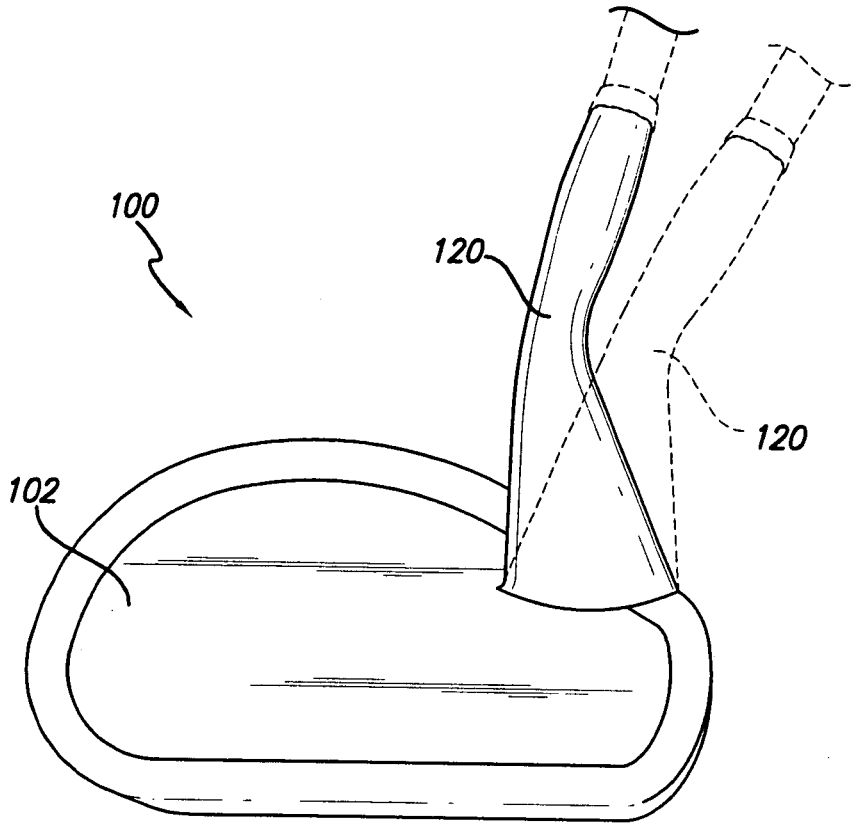
FIG. 4 is a front elevational view of the chipper in the present invention showing the flared hosel and an alternative angular disposition of the hosel with respect to the blade in phantom.
Figure 5:
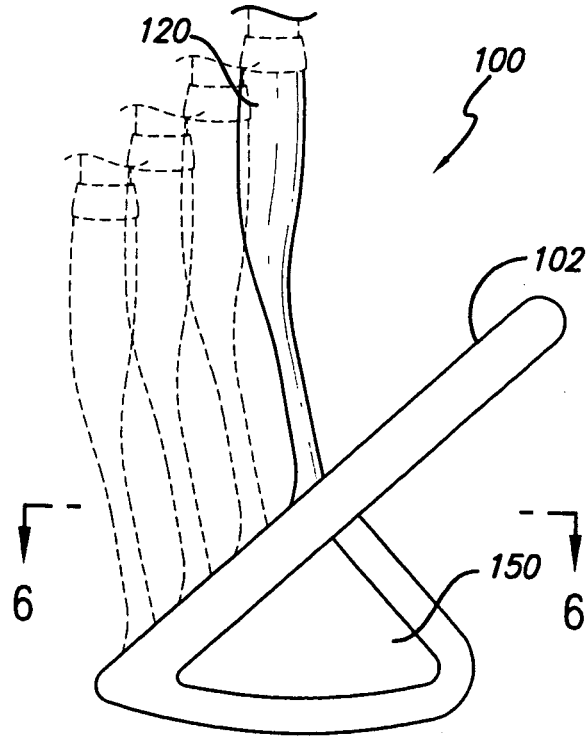
FIG. 5 is a left side elevational view of the flared chipper of the present invention showing the hosel in alternative positions with respect to the face of the blade in phantom.

In order to provide even further adjustability of the flared chipper or wedge of the present invention, FIGS. 4 and 5 indicate the selectable and adjustable nature of the hosel 120. In FIG. 4, the hosel may be adjusted with respect to the angle it enjoys with respect to the blade 102. Generally, such range of adjustable angle is contemplated as being from approximately 90 degrees to 65 degrees. This is generally indicated in FIG. 4 by the left most edge of the hosel 120 as it approaches the blade 102. Other angles may possibly advantageously be effected beyond the range set forth herein. However, general experience indicates that such a range may be more than enough to accommodate the great majority of golfers.

FIG. 5 shows additional and alternative placements of the hosel with respect to the blade 102. The hosel 102 may be advantageously placed anywhere along the face 104 of the blade 102 generally adjacent to the heel 110 of the blade 102. Such alternative dispositions enable the golf club head of the present invention to provide a wide variety of configurations when the hosel placement on the blade 102 is coupled with the angular adjustments available as indicated in FIG. 4. Consequently, the exemplary placements of the hosel 120 on the blade 102 are in no way meant to be limited to the placement of the hosel 120 on the blade 102. As indicated above, selection may be made of both the placement of the hosel as shown in FIG. 5 with the angular disposition of FIG. 4.

Figure 6:
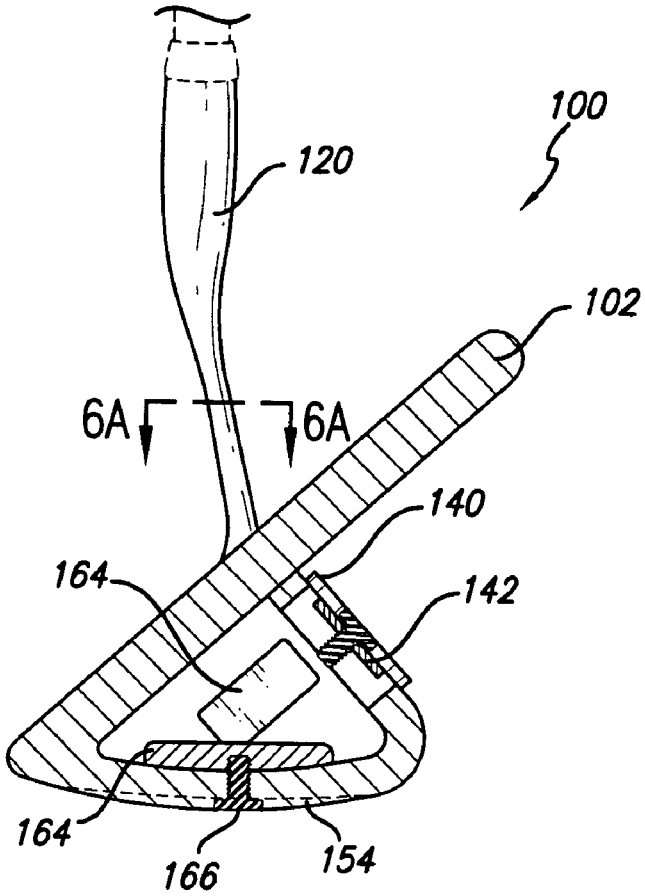
FIG. 6 is a left side cross-sectional view of the chipper shown in FIG. 5 taken generally along the line 6-6 thereof.

FIG. 6 shows a cross-sectional view of the golf club head 100 generally showing the confines of the interior cavity 160 with its weights 164 as well as the lid weights 142 affixed temporarily or permanently to lid 140.

Figure 6A:
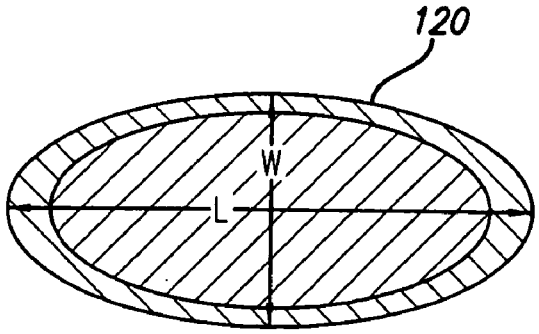
FIG. 6A is a cross-sectional of the hosel shown in FIG. 6 generally taken along the lines 6A-6A of FIG. 6.

The elliptical nature of the hosel 120 is shown in FIG. 6A. It is contemplated that the thickness of the elliptical hosel 120 may be in a range of approximately 5/16 of an inch in thickness and approximately 1 inch in length. The approximately 5/16 in width is indicated by reference letter W while the length is indicated by reference letter L. It is important the hosel 120 has sufficient mechanical strength so it does not break during the impact of the club with either the ball or the ground.

The elliptical nature of the hosel enables it to be significantly functional and less prone to breakage (and possibly unbreakable). The weight distribution available via the golf club head 100 is generally unlimited as any enclosable weight may be used in conjunction with the golf club head 100. The interior cavity 160 may be made larger or smaller and may vary in its width and length. It may have thinner or thicker walls in alternative embodiments of the present invention. One advantage of the present invention is that weight can be directed to specific areas as indicated in the drawings or as desired by the golfer. Weight distribution by the selectable choosing of the weights 142, 164 at the sole, at the heel, at the toe, at the sides, otherwise or any combination of these may be achieved through the present invention.

The lid 140 may be made of selectably lighter or heavier materials and may be thinner or thicker according to golfer preferences or performance of the golf club head 100. In an alternative embodiment, the lid 140 may have strips or grooves to increase or decrease the size of the lid and/or to increase or decrease its weight. Generally, the lid is of significant advantage to the golf club head 100 as its absence would generally create difficulties in placing weights in the interior cavity 160. Additionally, golfers may not feel comfortable in purchasing an open configuration due to the debris or other material that could collect within the interior cavity.

The sole 156 of the body 150 generally aids in preventing shanking and/or sculling on chip shots. Particularly, a bounce of two degrees, four degrees, or as selectably chosen during manufacture that is placed away from the leading edge 106 of the blade 102 may aid in such reduction of bad shots.

As indicated above, the golf club head 100 forms a key component of a flared chipper or a wedge golf club for golf. The specific configuration and design of the body 150 as well as the construction of the configuration of the blade 102 with its face 104 as well as the hosel 120 and the combination of these elements serve to provide an additional tool for the golfer by which he or she may make better shots. This is particularly true if the golfer's skills are ones that may tend to lead him or her to make bad shots. Furthermore, weight distribution within the golf club head 100 can lead to control of any "sweet spot" where impact is best made upon the golf ball. Such weight distribution may also serve to compensate for any detrimental idiosyncrasies the golfer may have in his or her swing. Furthermore, although the weights 142, 164 may be permanently attached, fabricated, forged, or cast into and with the golf club head 100 and the lid 140, such weights may also be removably or temporarily attached so that adjustment could be made in order to have the resulting golf club better serve the golfer's game.

While the present invention has been described with regards to particular embodiments, it is recognized that additional variations of the present invention may be devised without departing from the inventive concept.

What is claimed is:

1. A chipper or wedge golf club for golf, comprising:

a blade having an angled face having a lobed portion proximal to a toe of said blade;

a hosel coupled to said blade proximal to a heel of said blade, said hosel projecting from said face and at a boundary of said coupling having a generally elliptical cross section with a major axis generally parallel to a long axis of said blade and generally parallel to a leading edge of said blade;

a body extending rearwardly and below said blade, said body defining an interior cavity;

said interior cavity having an opening at a rearward portion thereof to provide access to said interior cavity;

said body providing a sole for said blade, said sole being generally convex along a long axis thereof generally extending from said heel to said toe and generally parallel to a plane of said face; and said sole defining a concave cavity, said concave cavity having a wider open portion proximal a leading edge of said blade and a narrower closed portion distal from said leading edge; whereby a chipper or wedge golf club is provided that aids a golfer in making more consistent golf shots of shorter distance.

2. A chipper or wedge golf club for golf as set forth in claim 1, further comprising:

said lobed portion positioned generally distally to said leading edge and said hosel, said lobed portion generally proximal to and above said toe.

3. A chipper or wedge golf club for golf as set forth in claim 1, further comprising:

said hosel being flared at a flared section proximal to said blade; and said hosel having a generally elliptical cross section at said flared section.

4. A chipper or wedge golf club for golf as set forth in claim 1, further comprising:

said hosel coupled to said blade proximal to said heel anywhere along said blade.

5. A chipper or wedge golf club for golf as set forth in claim 1, further comprising:

said hosel coupled to said blade at an angle from approximately the vertical (90°) to approximately 65°.

6. A chipper or wedge golf club for golf as set forth in claim 1, further comprising:

said blade extending upwardly and rearwardly past said body to provide a projecting portion of said blade.

7. A chipper or wedge golf club for golf as set forth in claim 1, further comprising:

a weight, said weight coupled to said body within said interior cavity.

8. A chipper or wedge golf club for golf as set forth in claim 7, further comprising:

said weight selected from the group consisting of: weights removably attachable to said body and weights permanently attached to said body.

9. A chipper or wedge golf club for golf as set forth in claim 1, further comprising:

a lid coupleable to said body, said lid covering said interior cavity.

10. A chipper or wedge golf club for golf as set forth in claim 9, further comprising:

a lid weight coupled to said lid on a side of said lid facing said interior cavity.

11. A chipper or wedge golf club for golf as set forth in claim 10, further comprising:

said lid weight selected from the group consisting of: lid weights removably attachable to said lid and lid weights permanently attached to said lid.

12. A chipper or wedge golf club for golf, comprising:

a blade having an angled face, said angled face having a leading edge, a heel, and a toe, said blade having a lobed portion proximal to said toe of said blade;

a hosel coupled to said blade proximal to a heel of said blade, said hosel being flared at a flared section proximal to said blade, and said hosel having a generally elliptical cross section at said flared section;

said hosel coupled to said blade proximal to said heel anywhere along said blade;

said hosel coupled to said blade at an angle from approximately the vertical (90°) to approximately 65°;

a body extending rearwardly and below said blade, said body defining an interior cavity, said interior cavity having an opening at a rearward portion thereof to provide access to said interior cavity;

said blade extending upwardly and rearwardly past said body to provide a projecting portion of said blade;

a weight, said weight being selectable and coupled to said body within said interior cavity; said weight selected from the group consisting of: weights removably attachable to said body and weights permanently attached to said body;

a lid coupleable to said body, said lid covering said interior cavity;

a lid weight, said lid weight being selectable and coupled to said lid on a side of said lid facing said interior cavity, said lid weight selected from the group consisting of: lid weights removably attachable to said lid and lid weights permanently attached to said lid;

said lobed portion positioned generally distally to said leading edge and said hosel, said lobed portion generally proximal to and above said toe;

said body providing a sole for said blade, said sole being generally convex along a long axis thereof generally extending from said heel to said toe and generally parallel to a plane of said face;

said sole defining a concave cavity, said concave cavity having a wider open portion proximal a leading edge of said blade and a narrower closed portion distal from said leading edge; whereby a chipper or wedge golf club is provided that aids a golfer in making more consistent golf shots of shorter distance.

13. A method of providing a chipper or wedge golf club for golf, comprising:

providing a blade having an angled face, said face having a lobed portion proximal to a toe of said blade;

coupling a hosel to said blade proximal to a heel of said blade, said hosel projecting from said face and at a boundary of said coupling having a generally elliptical cross section with a major axis generally parallel to a long axis of said blade and generally parallel to a leading edge of said blade;

providing a body, said body extending rearwardly and below said blade, said body;

defining an interior cavity in said body, said interior cavity having an opening at a rearward portion thereof to provide access to said interior cavity;

said body providing a sole for said blade, said sole being generally convex along a long axis thereof generally extending from said heel to said toe and generally parallel to a plane of said face; and defining a concave cavity in said sole, said concave cavity having a wider open portion proximal a leading edge of said blade and a narrower closed portion distal from said leading edge; whereby a chipper or wedge golf club is provided that aids a golfer in making more consistent golf shots of shorter distance.

14. A method of providing a chipper or wedge golf club for golf, comprising:

providing a blade having an angled face, said angled face having a leading edge, a heel, and a toe, said blade having a lobed portion proximal to said toe of said blade;

coupling a hosel to said blade proximal to a heel of said blade, said hosel being flared at a flared section proximal to said blade, and said hosel having a generally elliptical cross section at said flared section;

said hosel coupled to said blade proximal to said heel anywhere along said blade;

said hosel coupled to said blade at an angle from approximately the vertical (90°) to approximately 65°;

providing a body extending rearwardly and below said blade, said body coupled to said blade and defining an interior cavity, said interior cavity having an opening at a rearward portion thereof to provide access to said interior cavity;

said blade extending upwardly and rearwardly past said body to provide a projecting portion of said blade;

coupling a weight to said body, said weight being selectable and coupled to said body within said interior cavity; said weight selected from the group consisting of: weights removably attachable to said body and weights permanently attached to said body;

coupling a lid to said body, said lid covering said interior cavity;

coupling a lid weight to said lid, said lid weight being selectable and coupled to said lid on a side of said lid facing said interior cavity, said lid weight selected from the group consisting of: lid weights removably attachable to said lid and lid weights permanently attached to said lid;

said lobed portion positioned generally distally to said leading edge and said hosel, said lobed portion generally proximal to and above said toe;

said body providing a sole for said blade, said sole being generally convex along a long axis thereof generally extending from said heel to said toe and generally parallel to a plane of said face;

said sole defining a concave cavity, said concave cavity having a wider open portion proximal a leading edge of said blade and a narrower closed portion distal from said leading edge; whereby a chipper or wedge golf club is provided that aids a golfer in making more consistent golf shots of shorter distance.

* * * * *